US006984151B2

(12) United States Patent
Wu

(10) Patent No.: US 6,984,151 B2
(45) Date of Patent: Jan. 10, 2006

(54) ELECTRICAL CONNECTOR WITH NON-CONDUCTIVE COVER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/783,342

(22) Filed: Feb. 20, 2004

(65) Prior Publication Data

US 2005/0186846 A1 Aug. 25, 2005

(51) Int. Cl.
*H01R 9/03* (2006.01)

(52) U.S. Cl. ..... 439/610; 439/352; 439/465

(58) Field of Classification Search ..... 439/610, 439/352, 460–465
See application file for complete search history.

(56) References Cited

U.S. PATENT DOCUMENTS

| | | | | |
|---|---|---|---|---|
| 4,449,778 | A * | 5/1984 | Lane | 439/610 |
| 4,606,596 | A * | 8/1986 | Whiting et al. | 439/465 |
| 4,749,369 | A * | 6/1988 | Wang | 439/459 |
| 4,921,441 | A * | 5/1990 | Sauder | 439/460 |
| 5,195,909 | A * | 3/1993 | Huss et al. | 439/465 |
| 5,197,901 | A * | 3/1993 | Hashiguchi | 439/352 |
| 6,109,969 | A * | 8/2000 | Kuo et al. | 439/610 |
| 6,328,588 | B1 | 12/2001 | Tsai et al. | 439/352 |
| 6,619,987 | B2 | 9/2003 | Kumamoto et al. | 439/610 |
| 2003/0236017 | A1 | 12/2003 | Waddell et al. | 439/352 |

* cited by examiner

*Primary Examiner*—Michael C. Zarroli
(74) *Attorney, Agent, or Firm*—Wei Te Chung

(57) ABSTRACT

A cover for use with an electrical connector (1) includes a pair of hermaphroditic half cover members (3, 4) each having a pair of sidewalls (32), and a rear wall (34). Each of the sidewalls and the rear wall has an end surface (320, 340), a pillow (321, 341) projecting beyond the end surface, and a cutout (322, 342) defined along the end surface corresponding to the pillow. A notch (323, 343) is defined along an outer surface of each pillow and a detent (325, 345) is provided in the notch. A latching tab (324, 344) is disposed projecting beyond the end surface along the outer surface of each cutout, corresponding to the notch and having an opening (326, 346) therein. Each rear wall defines a semi-circular cable exit (347) in a center thereof and a pair of gaps (348) adjacent to the sidewalls.

24 Claims, 10 Drawing Sheets

ELECTRICAL CONNECTOR WITH NON-CONDUCTIVE COVER

BACKGROUND OF THE INVENTION

1. Field of the Invention

The present invention generally relates to an electrical connector, and more particularly to an electrical connector with a non-conductive protective cover.

2. Description of Related Art

U.S. Pat. No. 6,619,987 B2, assigned to Fujitsu Component Limited and issued on Sep. 16, 2003, discloses an electrical connector comprising a plug body, a board and a shield cover assembly. The plug body and the board form a plug receiving a plurality of contacts therein (as shown in FIG. 4 of the patent). The shield cover assembly includes a first half shield cover and a second half shield cover connected together. The first and second half shield covers are conductive and made of die-casing zinc which will ground with system chassis for providing electromagnetic interference (EMI) shielding. However, to prevent the shield cover assembly from touching with anything else to thereby occur a short circuit, it is necessary to provide an insulative cover for encasing the shield cover assembly therein.

U.S. Pat. No. 6,328,588 B1 (named as the '588 patent for simplification) discloses a cable connector which comprises a main body, a shielding shell having a top shell and a bottom shell attached together, and a cover unit covering the shielding shell. With reference to FIG. 2 of the '588 patent, the cover unit 6 has a top and a bottom portions 61, 62 attached together. The top portion 61 forms a first and a second side walls 63, 64 on opposite sides thereof. The bottom portion 62 forms a first and a second side walls 65, 66 on opposite sides thereof for correspondingly engaging with the first and the second side walls 63, 64 of the top portion 61. The first side wall 63 of the top portion 61 forms a first cutout 631 in an outer surface thereof and a pair of protrusions 633 on an inner surface thereof. The first side wall 65 of the bottom portion 62 has a first flange 651 upwardly extending therefrom corresponding to the first cutout 631 and a pair of latching tabs 653 upwardly extending from the bottom portion 62 along an inner surface thereof. Each tab 653 defines an opening 654 therein for fittingly receiving the protrusion 633. In assembly, the top and bottom portions are firmly attached together. However, when an external force is exerted on one sidewall of the cover unit, the external force is passed to and mostly accumulated on the latching tab. The latching tab is not blocked by anything when withstanding the external force. Because the latching tab is a thin wall upwardly extending from the bottom portion and has the opening, two sidewalls of the latching tab cannot endure enough external force and are easily subject to breakage, thus resulting in invalidation of the cover unit.

Additionally, in the above two patents, the connector has a plurality of contacts for engaging with an inserted mating connector, and a receiving space for receiving the mating connector. The receiving space of the connector is open to the outside and the contacts are unprotected. In this condition, contaminants, especially dust, may enter into the receiving space. When contaminants adhere to the surface of the contacts, they can degrade the electrical connection between the connector and the mating connector, and can further influence the quality of signal transmissions therebetween.

Hence, it is desired to provide an improved electrical connector to avoid the foregoing drawbacks.

SUMMARY OF THE INVENTION

A main object of the present invention is to provide an electrical connector having a non-conductive cover which can protect a die-casting shielding shell thereof from touching with anything else and occurring a short circuit.

Another object of the present invention is to provide an electrical connector which has a dust-proof cap steadily assembled to an insulative housing thereof so as to protect a plurality of terminals of the electrical connector and ensure the signal transmission.

In order to achieve the objects set forth, an electrical connector in accordance with the present invention comprises a shielded connector having a terminal subassembly, a lower and an upper shells, a pair of hermaphroditic half cover members for covering the upper and lower shell therein, and a dust-proof cap. The cap has a receiving space attached to a front end of the terminal subassembly and a pulling portion in a front end thereof. Each half cover member comprises a body wall, a pair of opposite sidewalls, and a rear wall connecting with the body wall and the sidewall, which together define a half receiving chamber. Each of the sidewalls and the rear wall has an end surface, a pillow projecting beyond the end surface, and a cutout defined along the end surface corresponding to configuration of the pillow. A notch is defined along an outer surface thereof in each pillow and a detent is provided in the notch. A latching tab is disposed projecting beyond the end surface along the outer surface thereof in each cutout, corresponding to the notch. Each rear wall defines a semicircular cable exit in a center thereof.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
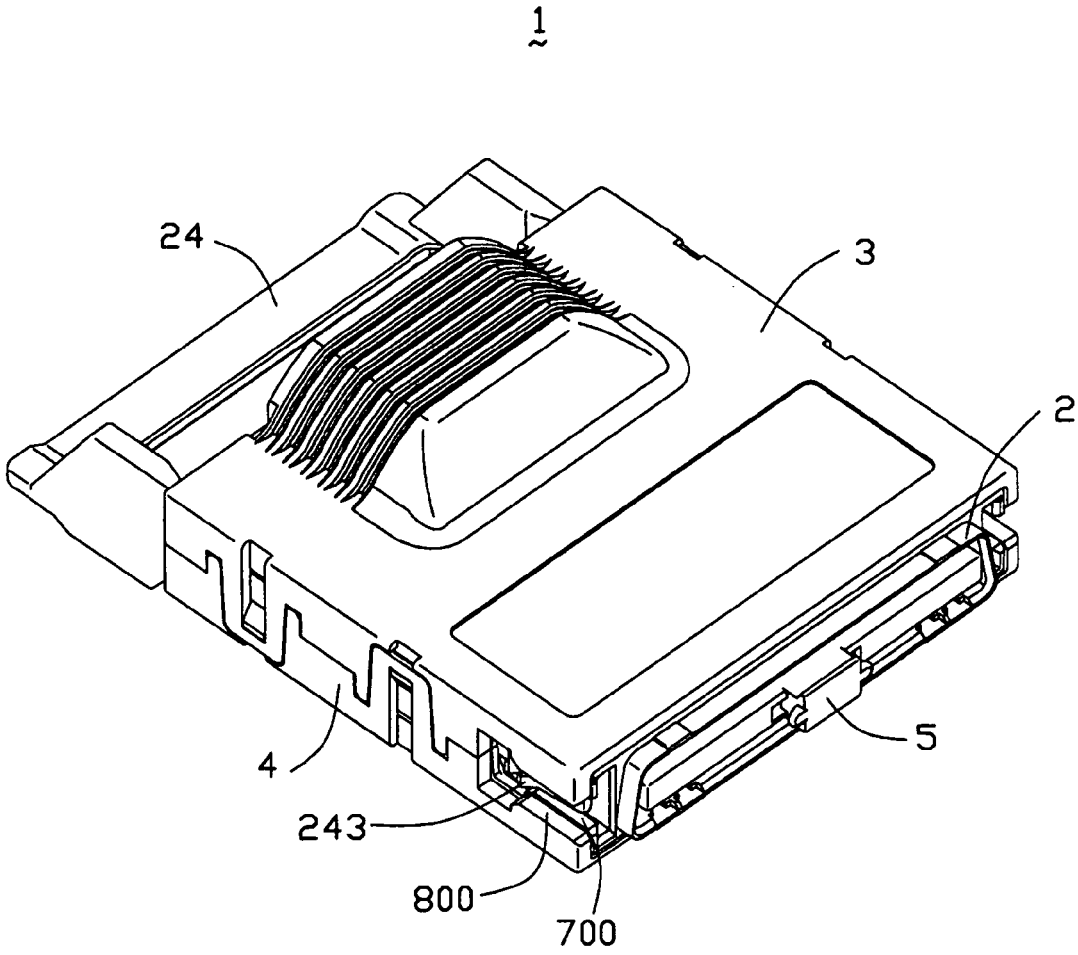
FIG. 1 is an assembled, perspective view of an electrical connector in accordance with the present invention.
Figure 2:
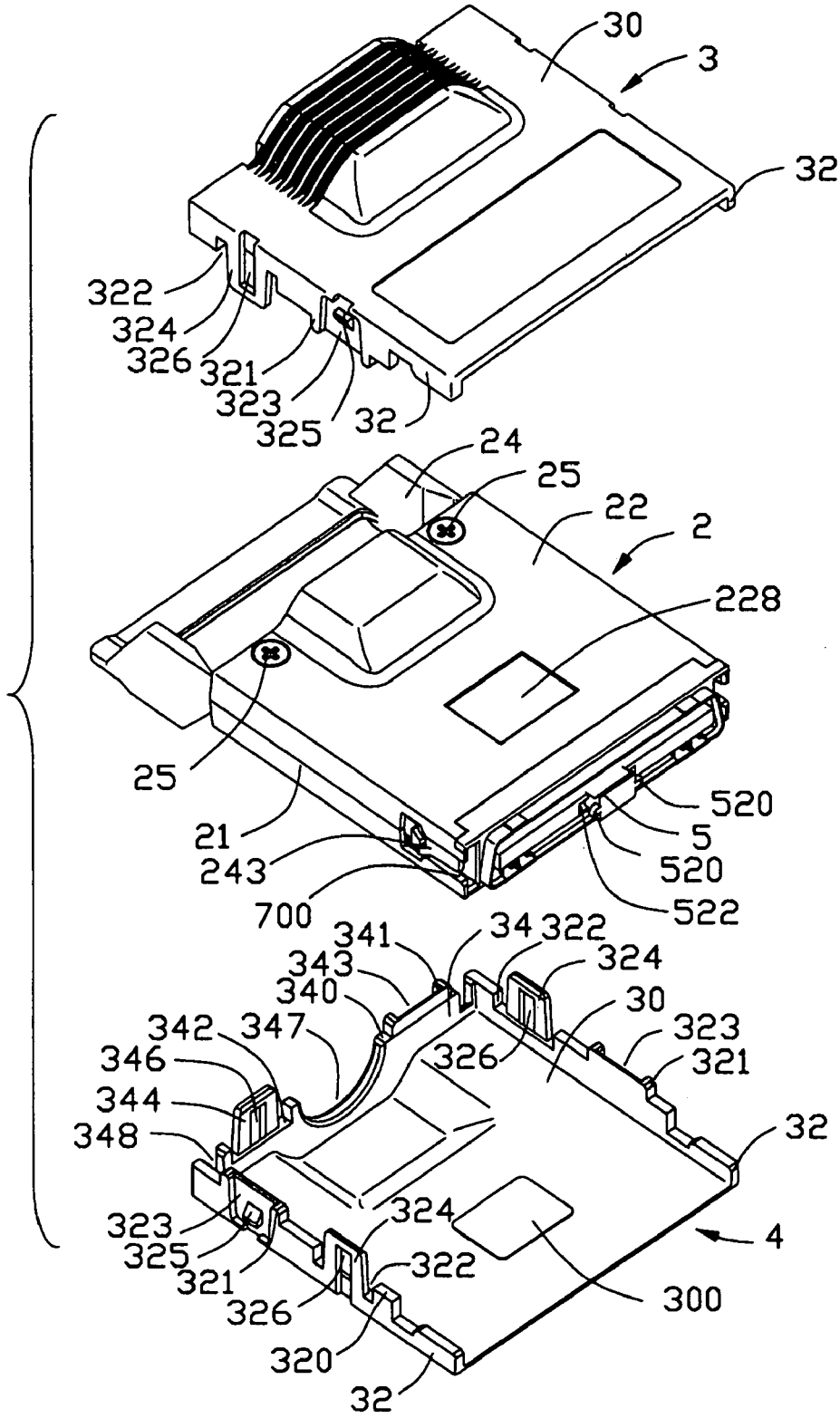
FIG. 2 is a partially exploded, perspective view of FIG. 1, showing an shielded connector with a dust-proof cap and a non-conductive cover before assembly.

Referring to FIGS. 1 and 2, an electrical connector 1 in accordance with the present invention comprises a shielded connector 2, a non-conductive cover made up of a pair of half cover members 3, 4, which are attached each other for encasing the shielded connector 2 therebetween, and a dust-proof cap 5 attached to a front end of the shielded connector 2.

Figure 3:
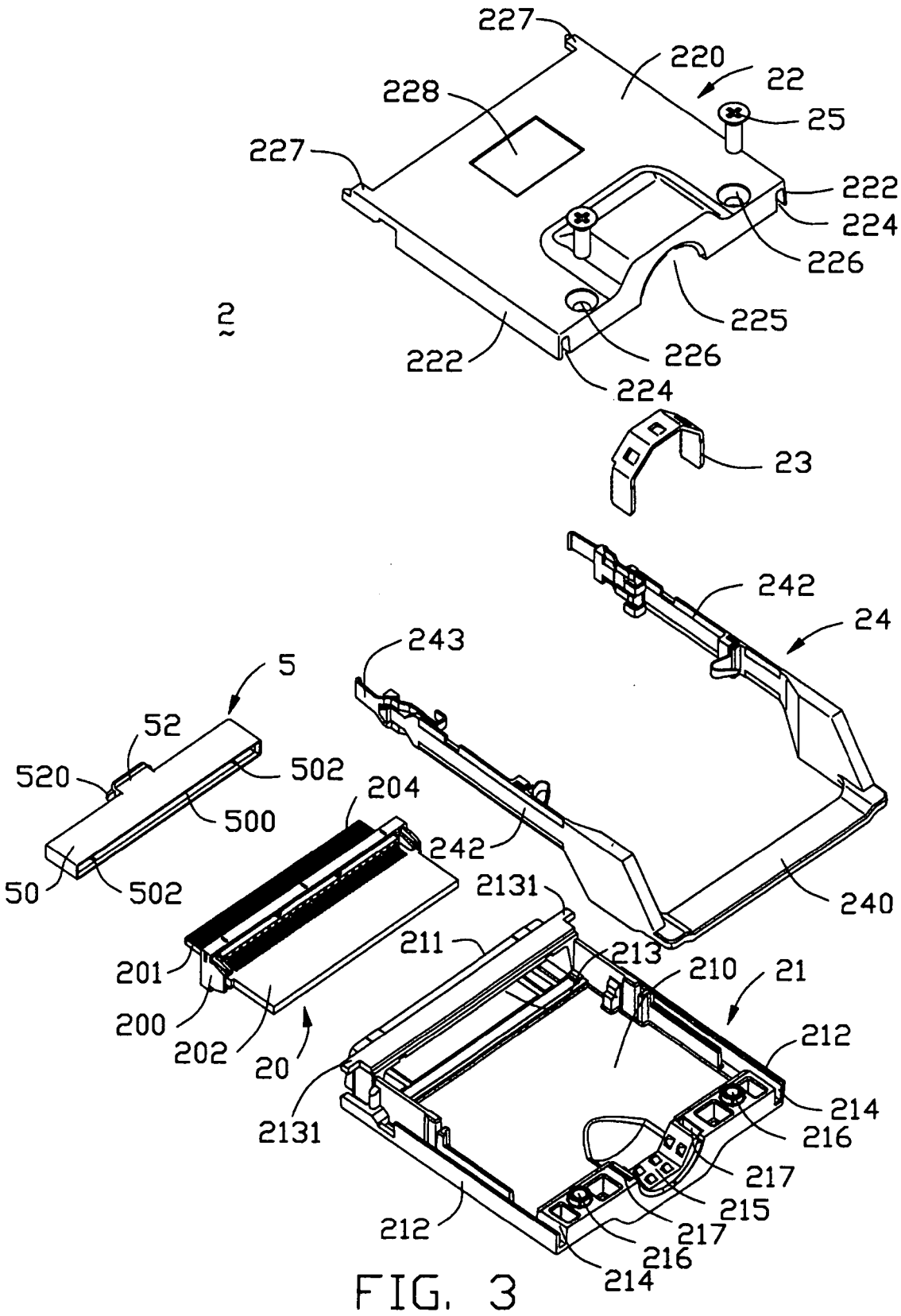
FIG. 3 is an exploded view of the shielded connector with the dust-proof cap.

Referring to FIG. 3, the shielded connector 2 comprises a terminal subassembly 20, a lower shell 21, an upper shell 22 for being assembled to the lower shell 21, a strain relief 23, a pull tab 24, and a pair of screws 25 for securing the upper shell 22 on the lower shell 21.

The terminal subassembly 20 comprises an insulating housing 200, a tongue blade 201 extending forwardly from the insulating housing 200, a printed circuit board (PCB) 202 assembled to a rear side of the insulating housing 200, and a plurality of terminals 204 received in the tongue blade 201 and extending through the insulating housing 200 to electrically connect to the PCB 202.

The dust-proof cap 5 includes a securing portion 50 for securing the dust-proof cap 5 to the shielded connector 2, and a pulling portion 52 projecting forwardly from the securing portion 50. The securing portion defines a receiving space 500 in a rear end thereof for receiving the tongue blade 201 of the terminal subassembly 20. A plurality of retention ribs 502 are provided in a top and a bottom walls of the receiving space 500 for enhancing retention force to prevent the dust-proof cap 5 from coming off the shielded connector 2. The pulling portion 52 has a pair of fingers 520 in two opposite sides thereof for facilitating holding by hand.

The lower shell 21 has a base plate 210, a mating frame 211 in a front end of the base plate 210 and a pair of sidewalls 212 upwardly extending from opposite lateral sides of the base plate 210. The mating frame 211 defines an aperture 213 extending therethrough and each sidewall 212 defines an elongated channel 214. The lower shell 21 defines a substantially semicircular lower passage 215 at a rear side thereof, a pair of screw holes 216 located at opposite sides of the semicircular lower passage 215, and a pair of slits 217 adjacent to the semicircular lower passage 215 for interferentially receiving the stain relief 23. The base plate 210 defines a rectangular recess 218 (as shown in FIG. 4) in an outer surface thereof.

The upper shell 22 has a cover plate 220 and a pair of sidewalls 222 downwardly extending from opposite lateral sides of the cover plate 220. Each sidewall 222 defines an elongated channel 224 corresponding to the channel 214 of the lower shell 21. The upper shell 22 defines a substantially semicircular upper passage 225 and a pair of holes 226 at a rear side thereof corresponding to the semicircular lower passage 215 and the screw holes 216, respectively. The cover plate 220 defines a rectangular recess 228 in an outer surface thereof.

The pull tab 24 comprises an operation portion 240 exposed outside of the upper and lower shells 22, 21 and a pair of arms 242 extending forwardly from opposite sides of the operation portion 240 and received in the channels 224, 214 of the upper and lower shells 22, 21.

Figure 4:
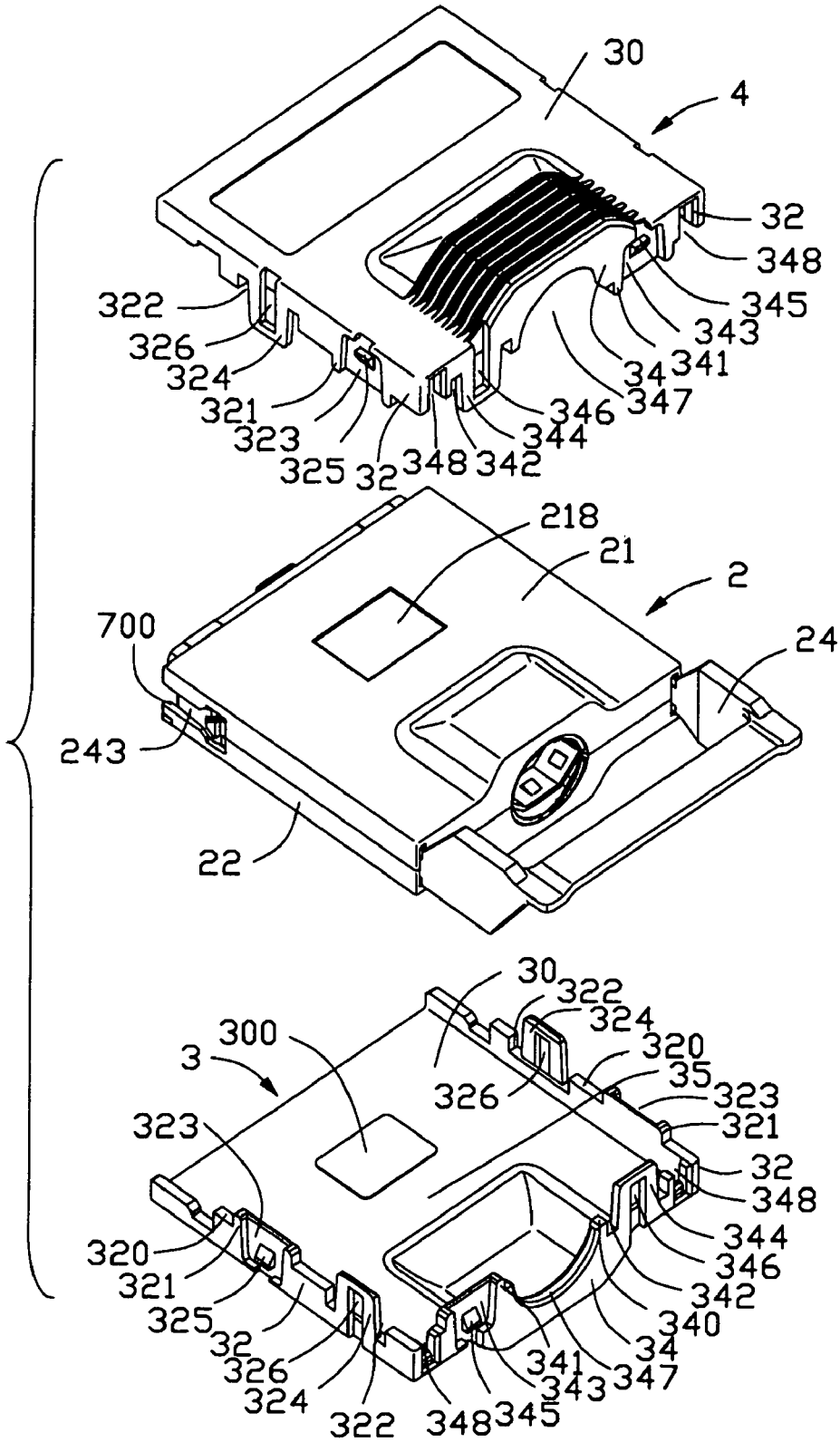
FIG. 4 is a view similar to FIG. 2, but taken from rear and bottom aspects.
Figure 5:
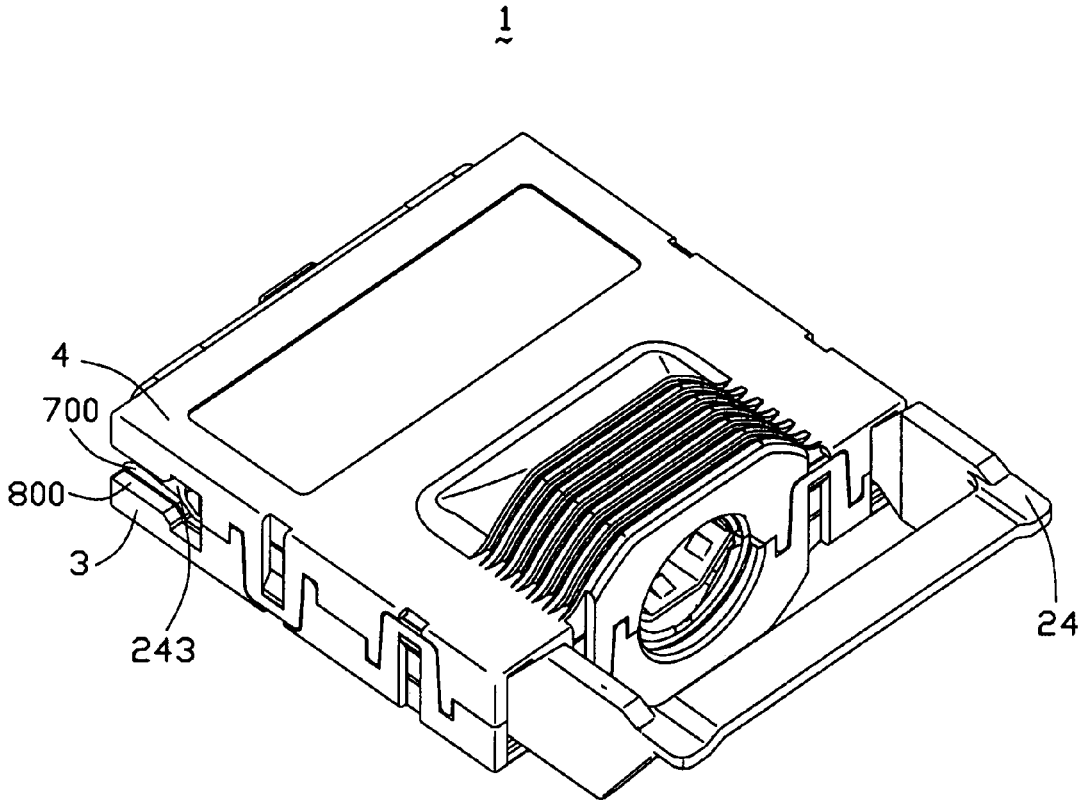
FIG. 5 is an assembled view of FIG. 4.

Referring to FIGS. 2, 4 and 5, the two half cover members 3, 4 in the preferred embodiment are hermaphroditic. The invention, however, is not limited thereto. Each half cover member 3, 4 comprises a body wall 30 having a rectangular protrusion 300 in an inner surface thereof, a pair of sidewalls 32 and a rear wall 34 connecting with the sidewalls 32 and the body wall 30, which together define a half receiving chamber 35. Each sidewall 32 of each half cover member 3, 4 has an end surface 320, a pillow 321 projecting beyond the end surface 320 toward its half cover member, and a cutout 322 defined along the end surface 320 corresponding to configuration of the pillow 321. The pillow 321 and the cutout 322 of one sidewall 32 respectively align with the cutout 322 and the pillow 321 of the other sidewall 32 in the same half cover member. The rear wall 34 of each half cover member has an end surface 340, and defines a substantially semicircular cable exit 347 in a center thereof and a pair of gap 348 adjacent to the sidewalls 32 for providing extension therethrough of the pull tab 24. A pillow 341 and a cutout 322 corresponding to configuration of the pillow 341 are respectively disposed in two opposite sides of the semicircular cable exit 347. Each of the sidewalls 32 and the rear wall 34 defines a notch 323, 343 in the pillow 321, 341 along an outer surface thereof and have a latching tab 324, 344 in the cutout 322, 342 projecting beyond the end surface 320, 340 toward associated half cover member along the outer surface thereof, corresponding to configuration of the notch 323, 343. The latching tab 323 and the notch 324, of one sidewall 32 respectively align with the notch 323 and the latching tab 324, of the other sidewall 32 in the same half cover member. Each of the sidewalls 32 and the rear wall 34 provides a detent 325, 345 in the notch 323, 343. Each latching tab 324, 344 of each of the sidewalls 32 and the rear wall 34 defines an opening 326, 346 therein for fittingly receiving a corresponding detent 325, 345.

Figure 6:
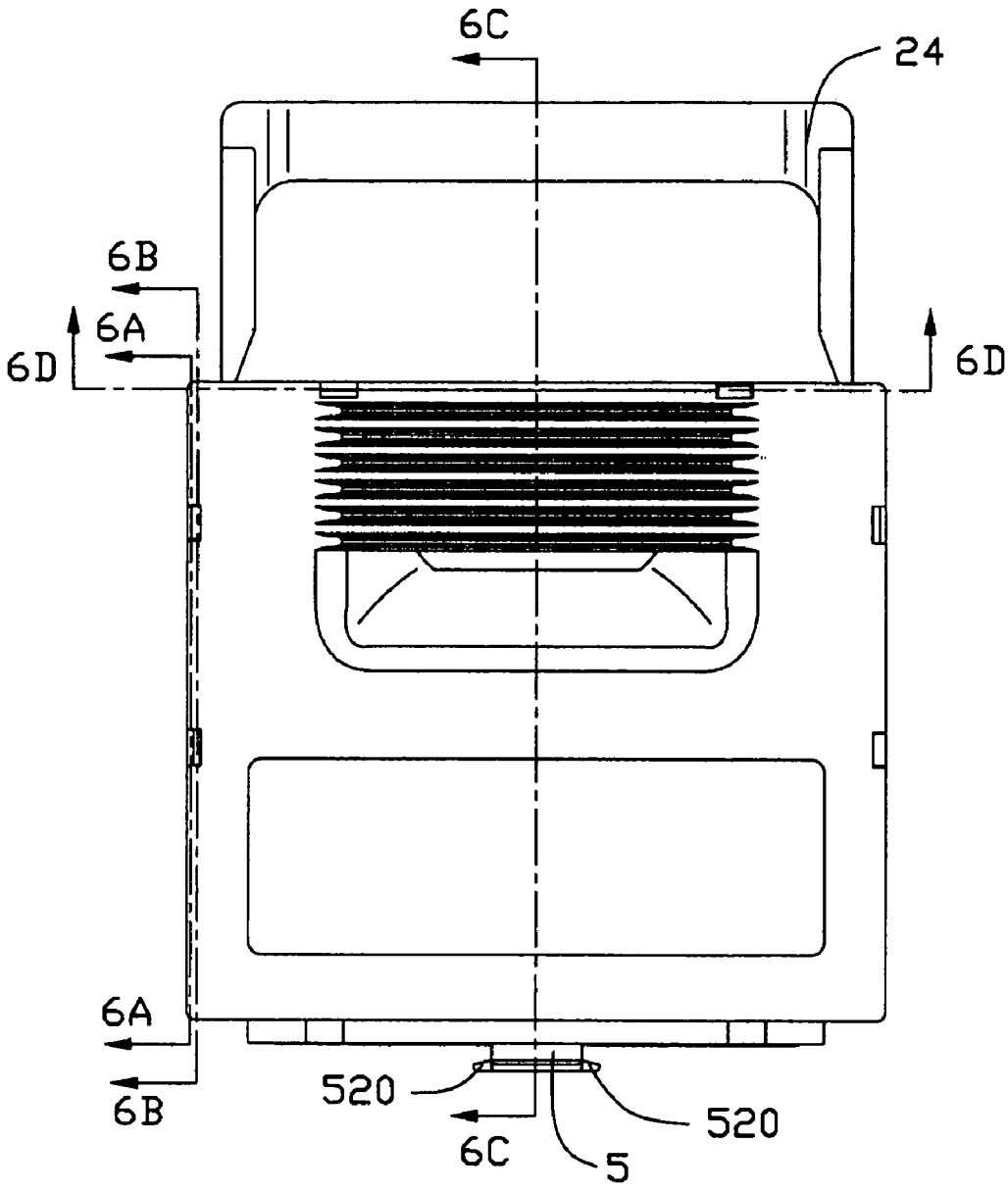
FIG. 6 is a top view of FIG. 1.
Figure 6A:
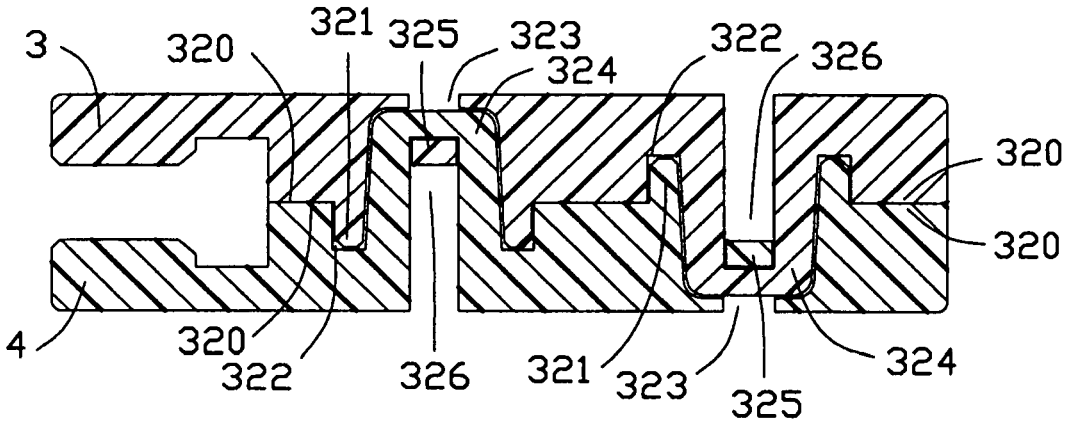
FIGS. 6A through 6D are cross-sectional views of the electrical connector taken along line 6A—6A through 6D—6D of FIG. 6, respectively.
Figure 6B:
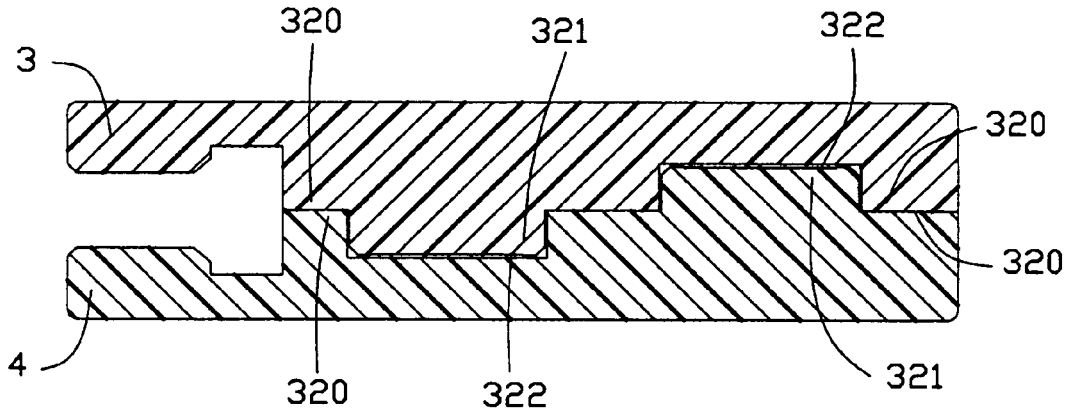
Figure 6C:
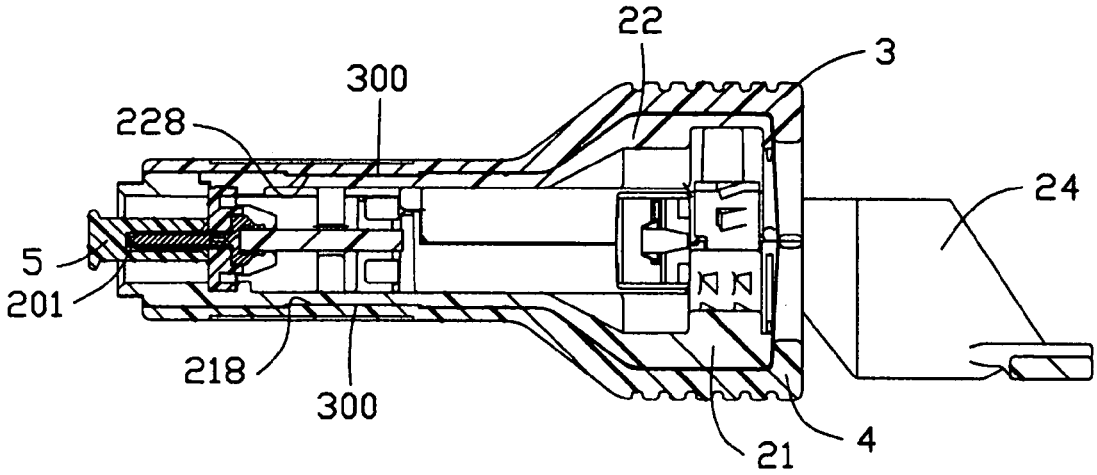
Figure 6D:
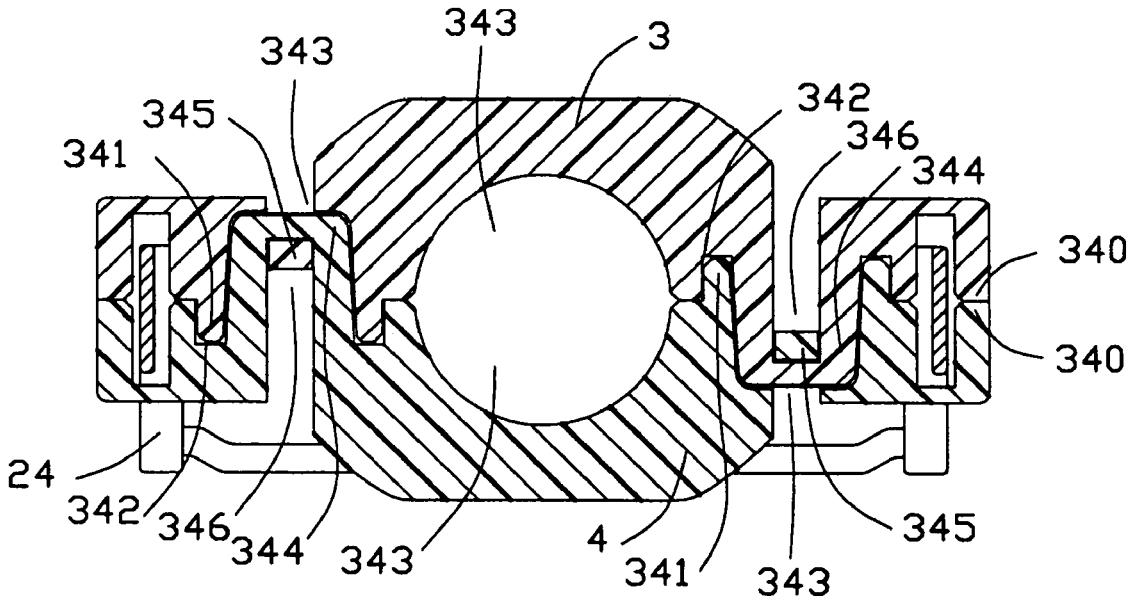

Referring to FIGS. 6A–6D in conjunction with FIG. 6, as the two half cover members 3, 4 are moved toward each other, the end surface 320, 340 of one half cover member abuts on the end surface 320, 340 of the other half cover member so as to form the protective cover, and the shielded connector is sandwiched between a integral cavity formed by the two half receiving chambers 35 of the half cover members 3, 4 with the mating frame of the shielded connector exposed beyond a front end of the cover. The rectangular protrusions 300 of the two half cover members 3, 4 are respectively positioned in corresponding rectangular recesses 228, 218 formed in the outer surfaces of the upper and lower shells 22, 21. The pillows 321, 341 of one sidewall 32 and the rear wall 34 of one half cover member are positioned in corresponding cutouts 322, 342 of the other sidewall 32 and the rear wall 34 of the other half cover member. The latching tabs 324, 344 of one sidewall 32 and the rear wall 34 of one half cover member are received in corresponding notches 323, 343 of the other sidewall 32 and the rear wall 34 of the other half cover member with the detents 325, 345 latchably engaged within corresponding openings 326, 346. Thereby, the two half cover members 3, 4 are firmly attached together to protect the upper and lower shells 22, 21 of the shielded connector 2.

One feature of the invention is to provide a full mating frame 211 on a front end of the lower shell 21 under a condition that a pair of protrusions 2131 are located about the mating frame 211. On the other hand, the upper shell 22 is provided with a pair of L-shaped protrusions 227 at the front end thereof. Accordingly, in assembling the upper shell 22 is initially engaged with the lower shell 21 at an rearwardly upwardly oblique angle under a condition that the pair of L-shaped protrusions 227 are engaged under the pair of protrusions 2131. Successively, the upper shell 22 is rotated toward the lower shell 21 about the engaged L-shaped protrusions 227 and protrusions 2131 until the rear end of the lower shell 21 and the rear end of the upper shell 22 abut against each other under a condition that the ridge of the screw hole 216 of the lower shell 21 is received in the corresponding blind hole (not shown) in the corresponding position of the upper shell 22. Finally, the screw 25 fastens the upper shell 22 and the lower shell 21 together. It is noted that because the pivotal point of this rotation is located about the upper portion of the upper shell 22, it is very easy without any improper interference during assembling the upper and lower shells 21, 22 together.

Another feature of the invention is to provide a plastic-molded dust-proof cover 5 which only shields the mating tongue blade 201 rather than the whole mating port of the connector. Additionally, because such a dust-proof cover 5 is equipped with the laterally extending fingers 520, it is intentionally formed with an opening 522 (FIG. 2) in alignment with the corresponding finger 320 for compliance with the molding process. Anther feature of the invention is to provide a lateral opening 800 in the front end of each side of the assembled two half cover members 3, 4, which is laterally aligned with the corresponding lateral opening 700 located in the front end of each side of the assembled two shells 21, 22, so as to expose the front end hook 243 of the corresponding arm 242 in a lateral direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising;

a shielded connector, comprising:

a terminal subassembly having an insulating housing and a plurality of terminals received in the housing;

a lower shell having a base plate, a mating frame in a front end of the base plate for receiving the terminal subassembly, and a pair of sidewalls upwardly extending from the base plate; and an upper shell attached to the lower shell; and having a cover plate and a pair of sidewalls downwardly extending from the cover plate; and a cover comprising:

a first cover member;

a second cover member;

a positioning means, comprising at least one pillow provided in one of the first and second cover members, and at least one cutout defined in the other cover member for receiving said at least one pillow; and a latching means comprising a detent disposed, in said at least one pillow, and a latching tab projecting from said at least one cutout and having an opening for latchably engaging with said detent;

wherein said terminal subassembly further comprises a tongue blade extending forwardly from the insulating housing, and a printed circuit board assembled to a rear side of the insulating housing, and said terminals are received in the tongue blade and extend through the insulating housing to electrically connect the printed circuit board.

2. The electrical connector as claimed in claim 1, further comprising a dust-proof cap assembled to said tongue blade.

3. The electrical connector as claimed in claim 2, wherein said dust-proof cap comprises a securing portion and a pulling portion projecting forwardly from the securing portion.

4. The electrical connector as claimed in claim 3, wherein said securing portion defines a receiving space for receiving the tongue blade and a plurality of retention ribs provided in an inner wall of the receiving space.

5. The electrical connector as claimed in claim 4, wherein said pulling portion has a pair of fingers in two opposite sides thereof for facilitating holding.

6. The electrical connector as claimed in claim 1, further comprising a pulling tab.

7. The electrical connector as claimed in claim 6, wherein said lower and upper shells each define an elongated channel in the sidewall thereof for receiving said pulling tab.

8. The electrical connector as claimed in claim 7, wherein each cover member defines a pair of gaps in two opposite sides of a rear wall thereof.

9. The electrical connector as claimed in claim 8, wherein said lower and upper shells define a recess in outer surfaces of the base plate and cover plate, respectively.

10. The electrical connector as claimed in claim 9, wherein each cover member has a protrusion in an inner surface thereof and positioned in said recess.

11. The electrical connector as claimed in claim 1, wherein said upper and lower shells each have a half cable passage in a rear side thereof.

12. The electrical connector as claimed in claim 11, wherein each cover member defines a half cable exit in a rear side thereof.

13. The electrical connector as claimed in claim 12, further comprising a strain relief.

14. The electrical connector as claimed in claim 13, wherein said lower shell defines a pair of slits in two opposite sides of the half cable passage.

15. The electrical connector as claimed in claim 1, wherein said first and second cover members are hermaphroditic.

16. A cover for use with an electrical connector, comprising:

a pair of hermaphroditic half cover members, each half cover member having a body wall, a pair of first and second sidewalls and a rear wall connecting with the side walls and the body wall, which together define a half receiving chamber, each of the sidewalls and the rear wall having an end surface; and wherein each of the first sidewall and the rear wall of one half cover member has a pillow projecting beyond the end surface toward associated half cover member, a notch defined in the pillow and a detent disposed in the notch;

wherein each of the second sidewall and the rear wall of the other half cover member defines a cutout along the end surface corresponding to said pillow, and a latching tab disposed in the cutout and projecting beyond the end surface toward associated half cover member, the latching tab defining an opening therein; and wherein when the two half cover members are attached together, the pillow of one half cover member is positioned in the cutout of the other half cover member, and said latching tab of the other half cover member is received in said notch of one half cover member with said detent latchably engaged within said opening.

17. The cover as claimed in claim 16, wherein each of the sidewalls and the rear wall of each half cover member comprises the pillow and the cutout.

18. The cover as claimed in claim 17, wherein the pillow and the cutout of one sidewall respectively align with the cutout and the pillow of the other sidewall in the same half cover member.

19. The cover as claimed in claim 18, wherein said notch is defined along an outer surface of the sidewall and said latching tab is defined along the outer surface of the sidewall.

20. The cover as claimed in claim 19, wherein each rear wall defines a substantially semicircular cable exit in a center thereof, and the pillow and the cutout of the rear wall are disposed in two opposite sides of the cable exit.

21. The cover as claimed in claim 20, wherein each rear wall defines a pair of gaps adjacent to the sidewalls.

22. An electrical connector assembly comprising:

a terminal assembly including an insulating housing with a plurality of terminals therein;

a mating tongue blade extending from the housing with a plurality of mating contact portions of said terminals thereon;

a conductive shell enclosing said housing and defining an open mating port with said mating tongue blade therein; and a plastic molded cap defining a receiving cavity only receiving said mating tongue blade; wherein said cap is assembled to the mating tongue blade and covers the mating tongue blade in a front-to-back mating direction of said open mating port while still exposing said open mating port in said front-to-back mating direction.

23. The assembly as claimed in claim 22, wherein said cap defines at least one finger accessible from an exterior for removing said cap from the mating tongue blade, and an through hole in alignment with said finger in said front-to-back mating direction.

24. A shielded connector including:

a terminal assembly having an insulative housing with a plurality of conductive terminals therein;

a pair of metallic lower and upper shells commonly defining therein a space receiving said terminal assembly, a first lateral opening formed at a front end of each side of the assembled lower and upper shells;

a pull tab assembled to the assembled lower and upper shells, said pull tab including a pair of arms with hooks at front ends thereof, respectively;

a pair of insulative cover members enclosing said assembled lower and upper shells, a second lateral opening formed at a front end of each side of the assembled cover members and laterally aligned with the corresponding first lateral opening to expose the corresponding hook in a lateral direction.

* * * * *